US009989901B2

(12) United States Patent
Kadowaki

(10) Patent No.: US 9,989,901 B2
(45) Date of Patent: Jun. 5, 2018

(54) IMAGE FIXING DEVICE HAVING A CONTROLLER THAT MAINTAINS A TEMPERATURE OF THE HEATER

(71) Applicant: CANON KABUSHIKI KAISHA, Tokyo (JP)

(72) Inventor: Hiroyuki Kadowaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/389,652

(22) Filed: Dec. 23, 2016

(65) Prior Publication Data

US 2017/0185016 A1 Jun. 29, 2017

(30) Foreign Application Priority Data

Dec. 25, 2015 (JP) ..... 2015-254206

(51) Int. Cl.
*G03G 15/20* (2006.01)

(52) U.S. Cl.
CPC ..... *G03G 15/2039* (2013.01); *G03G 15/2042* (2013.01); *G03G 2215/2035* (2013.01)

(58) Field of Classification Search
CPC ..... G03G 15/2039; G03G 15/2042; G03G 2215/2035
See application file for complete search history.

(56) References Cited

U.S. PATENT DOCUMENTS 6,518,546 B2 * 2/2003 Otsuka ..... G03G 15/2053 219/216
6,787,737 B2 * 9/2004 Uekawa ..... G03G 15/2053 219/216
8,942,589 B2 * 1/2015 Asami ..... G03G 15/2042 219/216
9,031,439 B2 * 5/2015 Hase ..... G03G 15/205 399/33
9,436,139 B2 9/2016 Kadowaki
2007/0183805 A1 * 8/2007 Tsukada ..... G03G 15/2039 399/69

(Continued)

FOREIGN PATENT DOCUMENTS

JP 4-44075 A 2/1992
JP 5-181378 A 7/1993

(Continued)

*Primary Examiner* — Francis Gray
(74) *Attorney, Agent, or Firm* — Fitzpatrick, Cella, Harper & Scinto

(57) ABSTRACT

A fixing device includes a cylindrical film, and a heater including a substrate, a first heat generating resistor, and a second heat generating resistor. A controller controls supply of electric power to the heater using one of PID control and PD control on the basis of a deviation between a target temperature and a detected temperature detected by a temperature detecting member, such that the temperature of the heater is maintained at the target temperature. A proportional gain of the PID control or the PD control when the first heat generating resistor is supplied with the electric power and the second heat generating resistor is not supplied with the electric power is less than a proportional gain of the PID control or the PD control when the first heat generating resistor is not supplied with the electric power and the second heat generating resistor is supplied with the electric power.

6 Claims, 7 Drawing Sheets

(56) References Cited

U.S. PATENT DOCUMENTS

2016/0216653 A1 7/2016 Yajima et al.

FOREIGN PATENT DOCUMENTS

| | | | |
|---|---|---|---|
| JP | 10-112377 | A | 4/1998 |
| JP | 2003-337484 | A | 11/2003 |
| JP | 2006-337761 | A | 12/2006 |
| JP | 2011-253062 | A | 12/2011 |
| JP | 2015-060208 | A | 3/2015 |

* cited by examiner

IMAGE FIXING DEVICE HAVING A CONTROLLER THAT MAINTAINS A TEMPERATURE OF THE HEATER

FIELD OF THE INVENTION AND RELATED ART

The present invention relates to an image forming apparatus equipped with a fixing device.

An image forming apparatus such as an electrophotographic copying machine and an electrophotographic printer has a fixing device which thermally fixes a toner image formed on a sheet of recording medium, to the sheet. One of the widely-used fixing devices is of the so-called film heating type, which is excellent in that it is substantially shorter in the length of time it takes to startup than fixing devices of the other types (Japanese Laid-open Patent Application No. H04-44075). In a case in which an electrophotographic image forming apparatus is used to continuously form images on a substantial number of sheets of recording medium, one for one, which are smaller, in terms of the direction perpendicular to the direction in which the sheets are conveyed through the apparatus, than other sheets of recording medium which the apparatus can accommodate, there occurs such a phenomenon that, in terms of the direction perpendicular to the recording medium conveyance direction, the portions (out-of-sheet-path portions) of the fixing device, which are outside the path of the smaller sheet of recording medium, gradually increase in temperature (unwanted temperature increase of out-of-sheet-path portions). If the temperature increase of the out-of-sheet-path portions of a fixing device becomes substantial, it sometimes occurs that some internal components of the fixing device are damaged. Therefore, some measures have to be taken to prevent the out-of-sheet-path portions of the fixing device from becoming excessively high in temperature. One of the methods thought to deal with this problem is described as follows, for example. That is, when it is necessary to thermally fix images in succession to a substantial number of smaller sheets of recording medium, one for one, the fixing device is set relatively longer in recording medium conveyance interval so that the out-of-sheet-path portions of the fixing device are allowed to substantially reduce in temperature before the next image is fixed. This method, however, is problematic in that it reduces in productivity of the image forming apparatus equipped with a fixing device which is controlled in the above-described manner.

Thus, various methods for dealing with the above-described issue have been proposed. One such method is disclosed in Japanese Laid-open Patent Application No 2003-337484. According to this patent application, the fixing device is provided with a heating means having a substrate, and a pair of heat generating resistors which are different in length. One of the heat generating resistors is disposed on one (first) primary surface of the substrate, and the other one of the heat generating resistors is disposed on another (second) primary surface of the substrate. Further, the fixing device is structured so that one, or a combination, of the two heat generating resistors can be selected for fixation, according to the size of the sheet of recording medium, in order to prevent the out-of-sheet-path portions of the fixing device from excessively increasing in temperature, without reducing the fixing device in productivity. In addition, as compared to a fixing device structured so that all the heat generating resistors, which are different in length, are disposed on the same surface of the substrate, this fixing device is structured so that the heat generating resistors are disposed on the top and back surfaces of the substrate, one for one. Therefore, the structural arrangement for this fixing device does not require the substrate of the heating means to be increased in size (width), contributing to the efforts to reduce a fixing device in size.

The fixing device disclosed in Japanese Laid-open Patent Application No. 2003-337484 is structured so that the temperature of its heating means is detected by a thermistor disposed on the back surface of the substrate. Therefore, in a case in which heat is generated by the heat generating resistor on the back surface of the substrate, the heat generated by the heat generating resistor reaches the thermistor on the back surface of the substrate through an insulative protective layer. On the other hand, in a case in which the heat is generated by the heat generating resistor on the front surface of the substrate, the heat generated by the heat generating resistor reaches the thermistor through not only the insulative protective layer, but also through the substrate. Therefore, when the heat generating resistor on the front surface of the substrate is used to generate heat, the temperature detecting means (thermistor) is slower in terms of responsiveness to the heat generated by the heat generating resistor than when the heat generating resistor on the back surface of the substrate is used to generate heat. That is, the length of time it takes for the heat generated by the heat generating means to reach the temperature detecting means (thermistor) is affected by which of the heat generating resistors is used to generate heat, the one on the front surface of the substrate of the heat generating means, or the one on the back surface of the substrate.

In the case of the above-described method for controlling the temperature of the fixation film of the fixing device of the so-called film-heating type, the film temperature is kept at a target level by controlling the electric power, which is to be supplied to the heat generating resistor(s), in response to a value calculated based on a prescribed formula. Ordinarily, a parameter used to calculate the amount by which electric power is to be supplied to the heat generating resistor(s) is determined in consideration of the above-described length of time it takes for the heat generated by the heat generating means to reach the temperature detecting means (thermistor). However, the optimal value for the parameter for the prescribed formula is affected by whether the heat generating resistor on the top or back surface of the substrate is used. Therefore, it is impossible to accurately calculate the amount by which electric power is to be supplied to the heat generating resistor(s). That is, the above-described method for controlling the temperature of the heating film has been problematic in that when the heat generating resistor on the front surface of the substrate is used for heat generation, the heat generating means cannot be controlled in temperature in the same manner as when the heat generating resistor on the back surface of the substrate is used, and vice versa, and therefore, the film temperature fluctuates up and down relative to the target level. This problem sometimes causes additional problems, namely that an image forming apparatus outputs prints which are not uniform in gloss, images outputted on a sheet of OHP film is nonuniform in transparency, or the like. Moreover, as the fixation film temperature deviates from the desired temperature range, which includes the target level, such problems as "hot offset" and "cold offset" occur.

SUMMARY OF THE INVENTION

According to an aspect of the present invention, there is provided a fixing device for fixing an image on a recording material, the fixing device comprising a cylindrical film; a heater contacting said film, said heater including a substrate, a first heat generating resistor provided on a first surface of said substrate which opposes said film, and a second heat generating resistor provided on a second surface of said substrate which is opposite from said first surface; a temperature detecting member configured to detect a temperature of said heater at the side having said second surface; and a controller configured to control electric power supply to said heater using PID control or PD control on the basis of a deviation between the target temperature and a detected temperature detected by said temperature detecting member such that the detected temperature is the target temperature, wherein the image is fixed on the recording material by heat generated by said heater, and wherein a proportional gain of the PID or PD control is smaller when the first heat generating resistor is supplied with the electric power, and said second heat generating resistor is not supplied with the electric power than when the first heat generating resistor is not supplied with the electric power, and the second heat generating resistor is supplied with the electric power.

Further features of the present invention will become apparent from the following description of exemplary embodiments with reference to the attached drawings.

Figure 3:
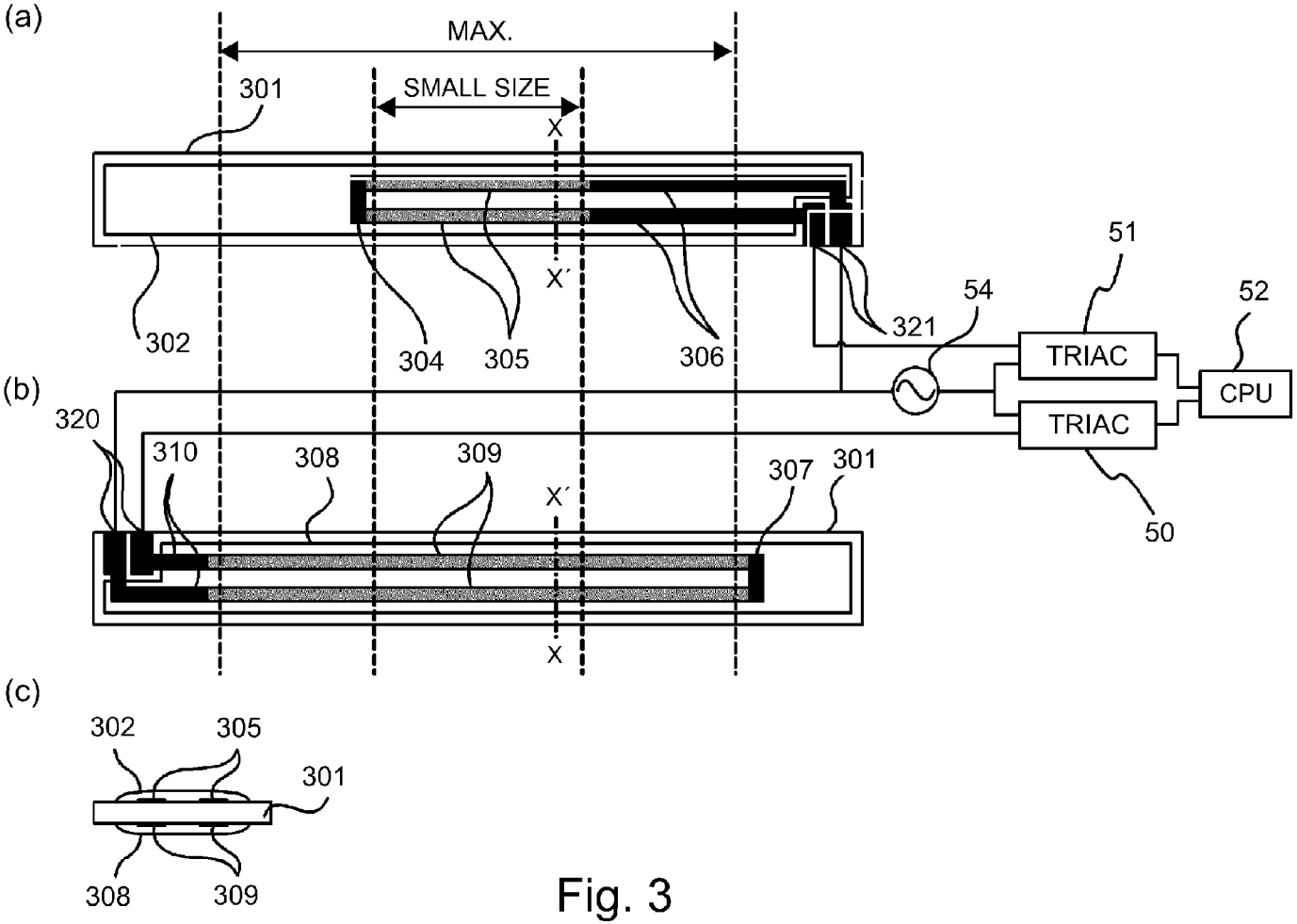

Parts (a), (b) and (c) of FIG. 3 are schematic drawings of the heater of the fixing device in the first embodiment, and show the general structure of the heater.

Figure 4:
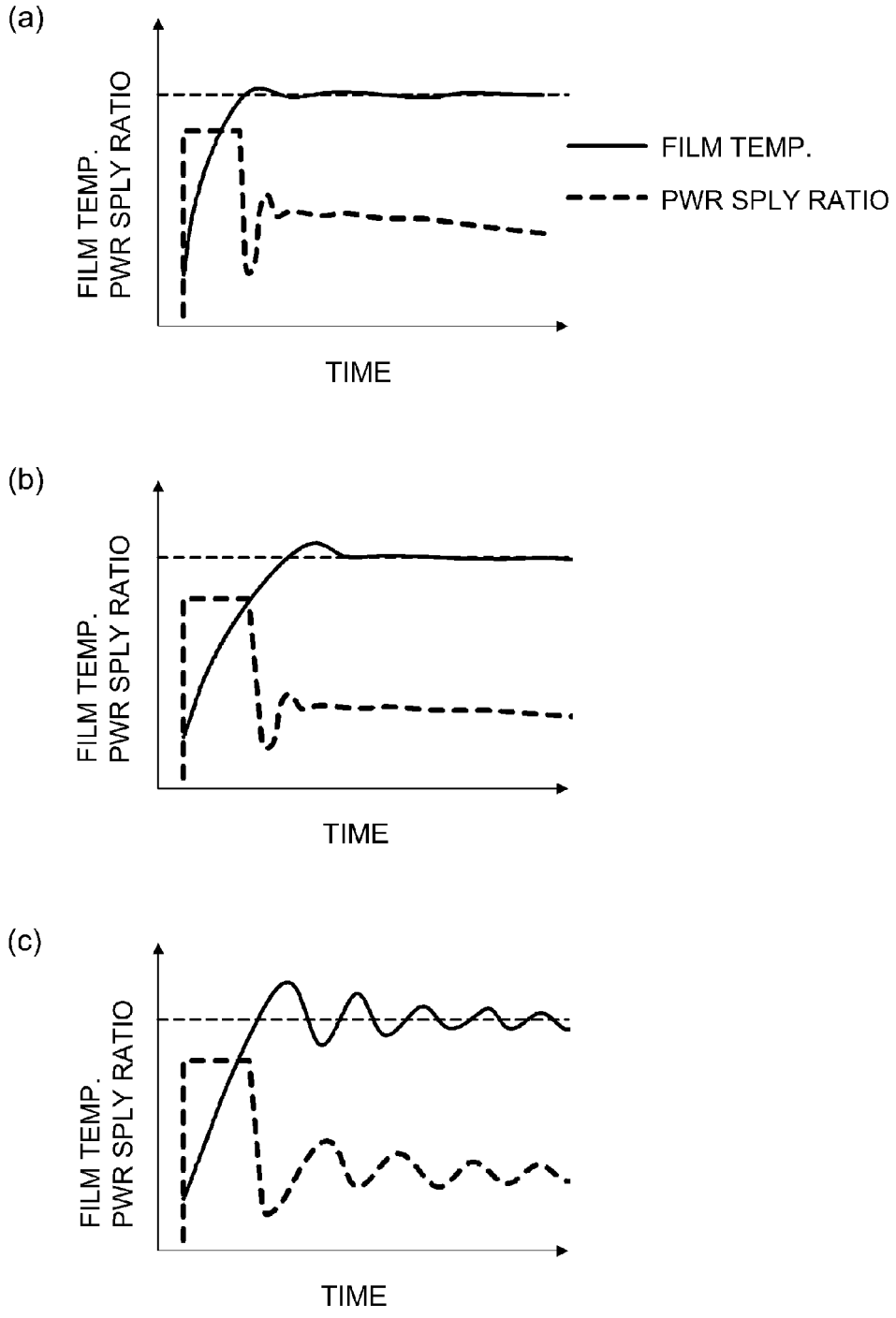

Parts (a), (b) and (c) of FIG. 4 are graphs for showing the relationship between the temperature of the heating film and the power-on ratio of the heating means of the fixing device in the first embodiment, and that of a comparative fixing device.

Figure 5:
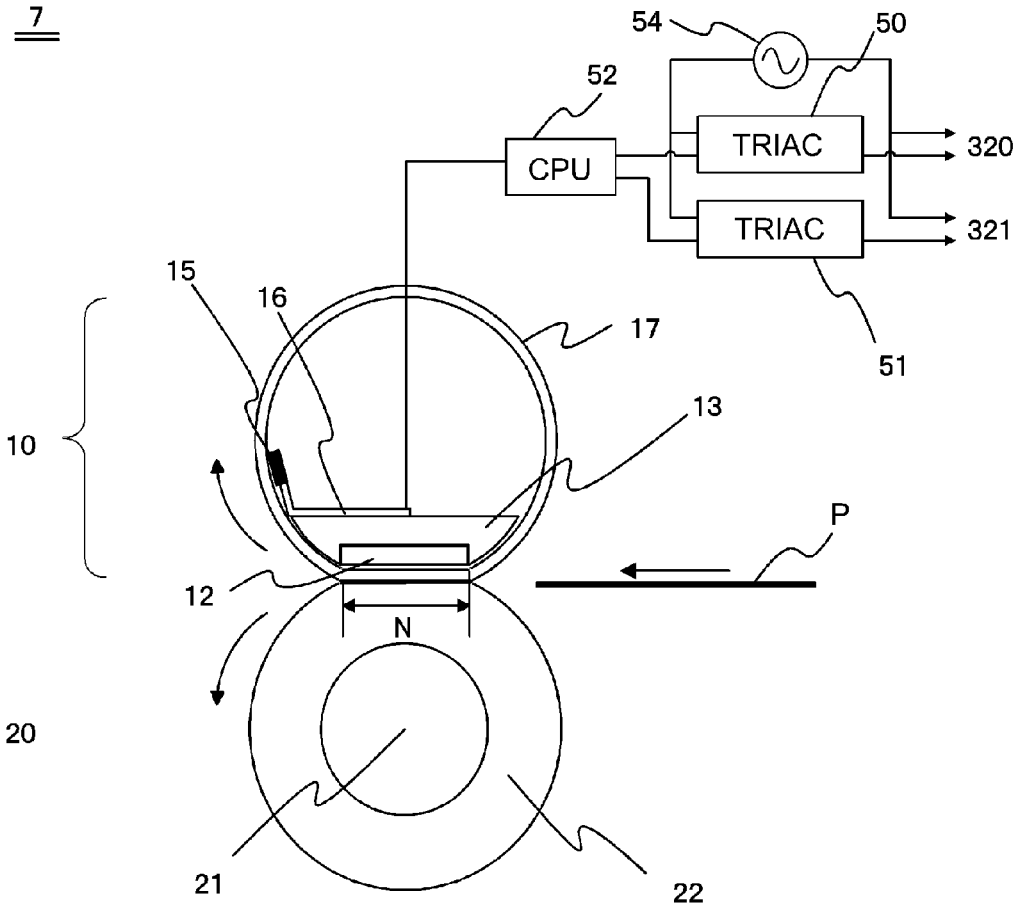

FIG. 5 is a schematic sectional view of the fixing device in the second embodiment of the present invention.

Figure 6:
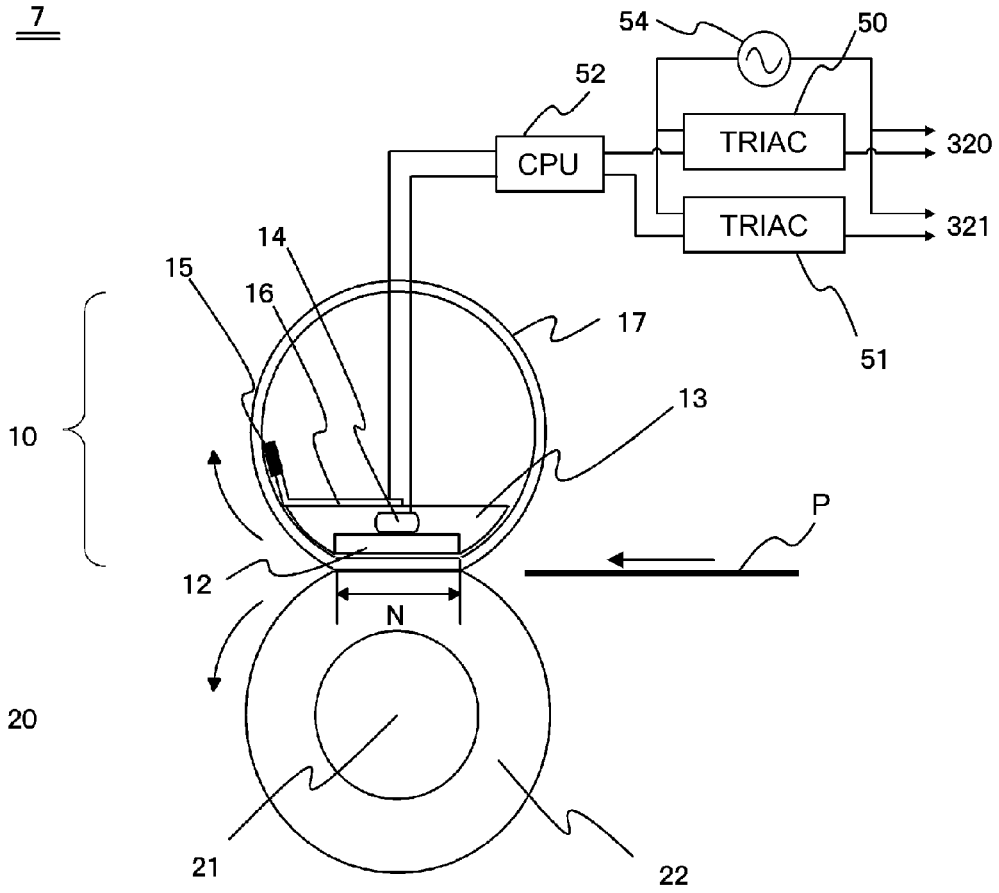

FIG. 6 is a sectional view of the fixing device in the third embodiment of the present invention.

Figure 7:
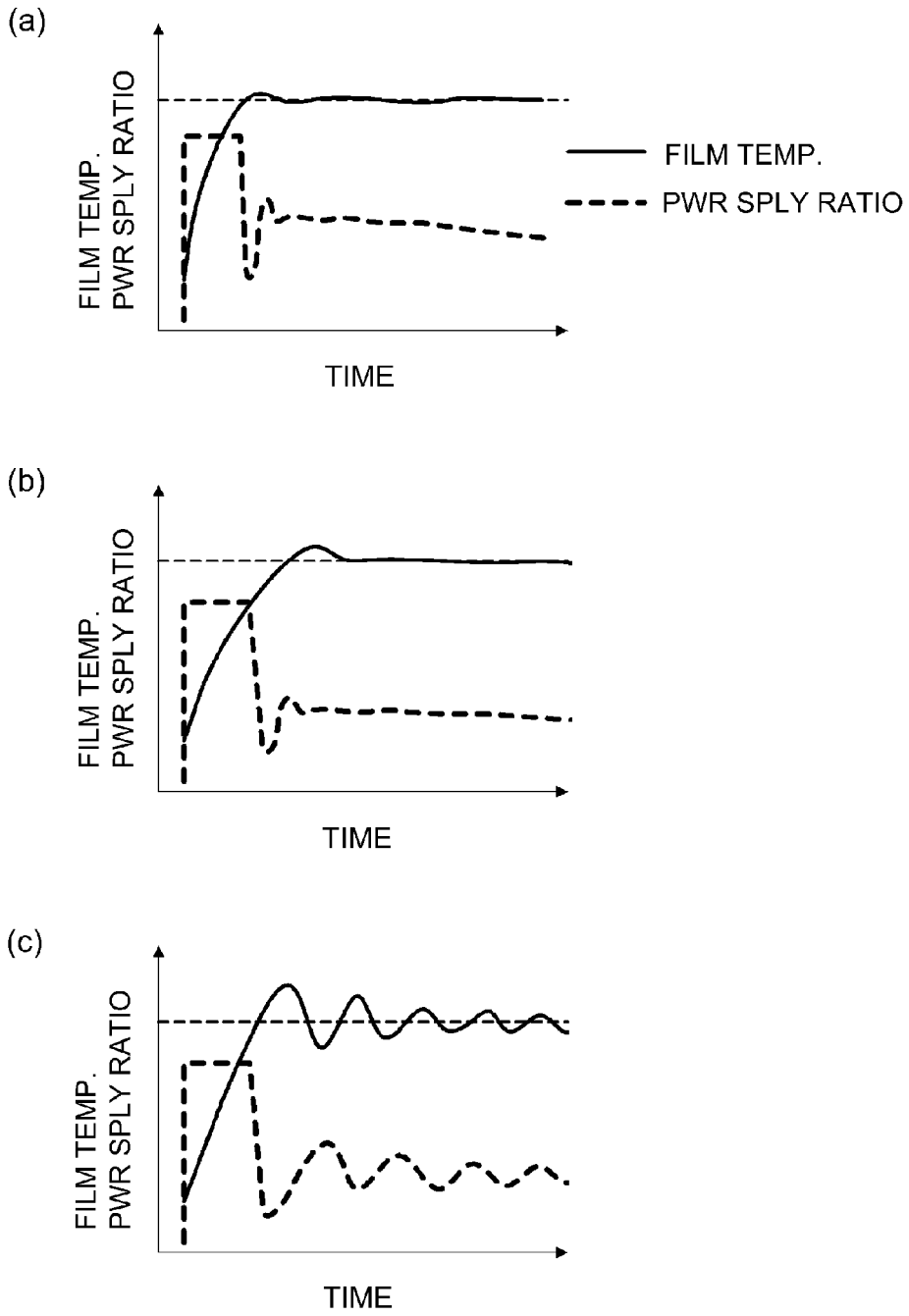

Parts (a), (b) and (c) of FIG. 7 are graphs which show the relationship between the temperature of the heating film and the power-on ratio, of the fixing device in the third embodiment, and that in the comparative fixing device.

DESCRIPTION OF THE EMBODIMENTS

Hereinafter, the present invention is described with reference to a few of the preferred embodiments of the present invention with the reference to appended drawings. However, the measurements, materials, shapes of the structural components of the fixing devices, and the positional relationship among the structural components in the following embodiments are intended to be modified according to the structure of an apparatus to which the present invention is applied, and the various conditions under which the present invention is applied. That is, the following embodiments are not intended to limit the present invention in scope.

Embodiment 1

Figure 1:
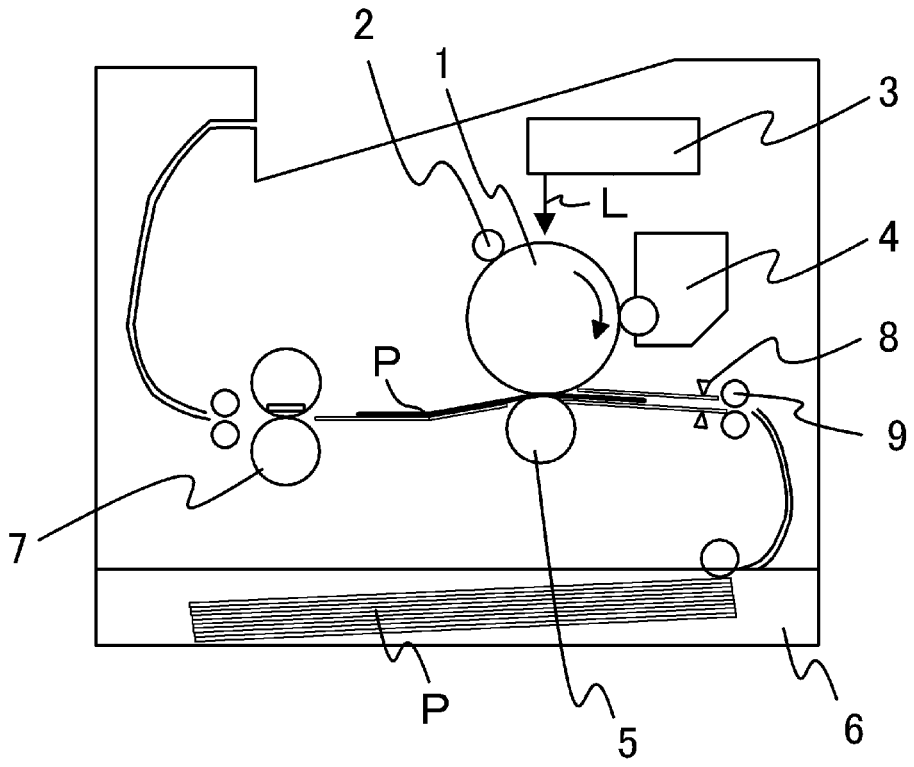
FIG. 1 is a schematic sectional view of a typical image forming apparatus to which the present invention is applicable.

FIG. 1 is a schematic sectional view of a laser printer (which hereafter will be referred to simply as "printer"), which is an example of an image forming apparatus to which the present invention is applicable. It shows the general structure of the printer. Reference numeral 1 stands for a photosensitive drum, which is rotationally driven so that its peripheral surface is uniformly charged by a charge roller 2 as a charging device. As the peripheral surface of the photosensitive drum 1 is uniformly charged, it is exposed to a beam L of laser light emitted by a laser scanner 3 in a manner to scan the peripheral surface of the photosensitive drum 1 while being turned on or off in accordance with the information of the image to be formed. Consequently, an electrostatic latent image is formed on the peripheral surface of the photosensitive drum 1. This electrostatic latent image is developed by a developing device 4 into a visible image, which hereafter will be referred to as toner image (or developer image), on the peripheral surface of the photosensitive drum 1 by the adhesion of toner to the electrostatic latent image. Then, the toner image on the photosensitive drum 1 is transferred onto a sheet P of recording paper (recording medium) conveyed to the transfer nip from a sheet feeder cassette 6 with preset timing. The transfer nip N is the area of contact between a transfer roller 5 and photosensitive drum 1. During this process of transferring the toner image onto the sheet P of paper, the leading edge of the sheet P, in terms of the direction in which the sheet P is conveyed by a sheet conveyance roller 9, is detected by a top sensor 8 to ensure that the leading edge of the toner image in terms of the rotational direction of the photosensitive drum 1 and the leading edge of the portion of the sheet P, in terms of the recording medium conveyance direction, onto which the toner image is to be transferred, arrive at the transfer nip at the same time. As the sheet P of paper is conveyed to the transfer nip with the preset timing, it is conveyed through the transfer nip while remaining pinched between the photosensitive drum 1 and transfer roller 5, and therefore, while remaining subjected to a preset amount of pressure. After the transfer of the toner image onto the sheet P of recording paper, the sheet P is conveyed to a fixing device 7 as a fixing portion, in which the toner image is thermally fixed to the sheet P. Then, the sheet P is discharged onto a delivery tray.

Figure 2:
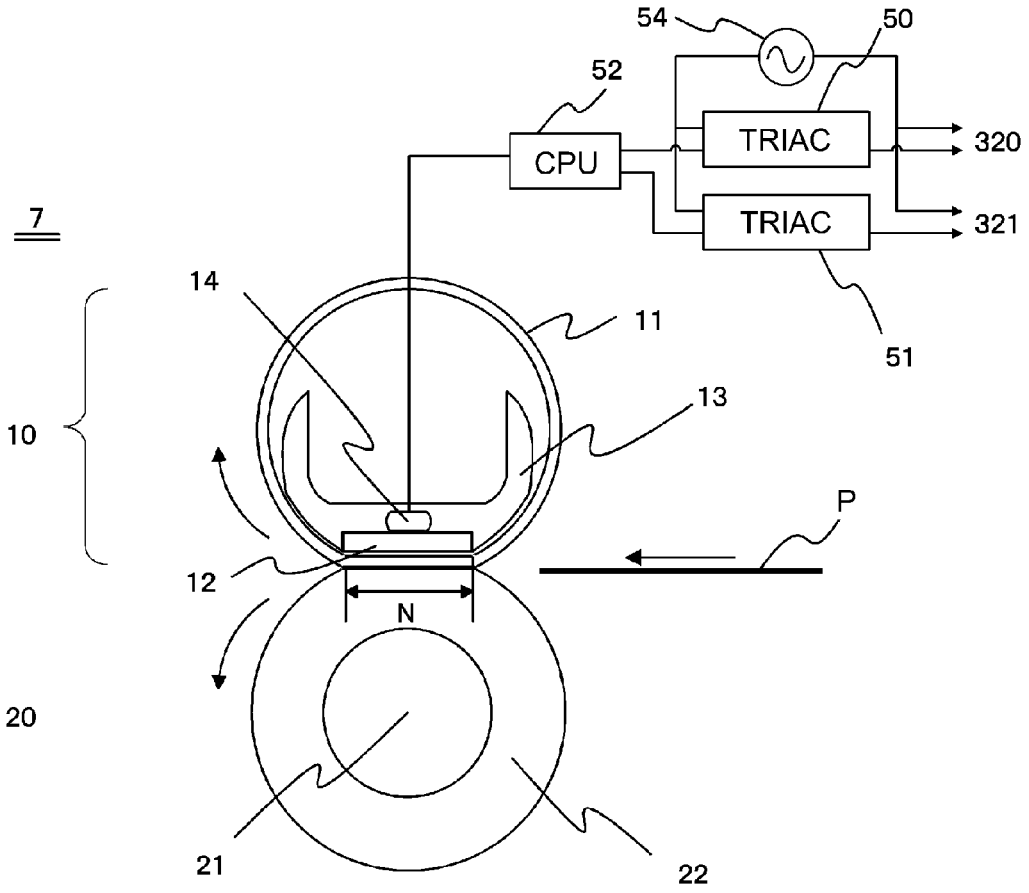
FIG. 2 is a schematic sectional view of the fixing device in the first embodiment of the present invention.

Next, referring to FIG. 2, the fixing device 7 in this embodiment is described. FIG. 2 is a sectional view of the fixing device 7. The fixing device 7 has a heating member 10, and a pressure roller 20 as a pressure applying member. The heating member 10 and pressure roller 20 are pressed against each other to form a fixation nip N. The heating member 10 has a film heating heater 12 (which hereafter referred to simply as "heater"), a film guide 13 to which the heater 12 is fixed, and a cylindrical heating film 11 which is loosely fitted around the film guide 13.

The heating film 11 (which hereafter will be referred to simply as "film") is flexible and heat resistant. In order to ensure that the fixing device 7 quickly starts up, a cylindrical film which is 80 μm in overall thickness, being therefore low in thermal capacity, is used as the film 11. As the material for the substrative layer of the film 11, heat resistant resin such as polyimide, polyamideimide, PEEK, or the like can be used. In this embodiment, polyimide, which is one of the heat resistant resins and is 65 μm in thickness, is used as the material for the substrative layer. The outward surface of the substrative layer of the film 11 is covered with a release layer which is formed of one, or a mixture, of heat resistant resins such as PTFE, PFA and FEP, or silicone resin, which are excellent in terms of releasing properties. In this embodiment, the substrative layer is covered with a thin layer of PFA (fluorine resin) which is 15 μm in thickness. Also in this embodiment, in order to make it possible for a sheet of recording paper of the letter size (216 mm in dimension in terms of direction perpendicular to sheet of paper on which FIG. 2 is drawn) to be conveyed through the fixing device 7, the size (width) of the film 11 was set to 240 mm. The external diameter of the film 11 is 24 mm.

The film guide 13 is such a guiding member that functions as not only a member for supporting the heater 12, but also as a member for guiding the film 11 while the film 11 is rotationally driven. The film 11 is loosely fitted around the film guide 13 so that the film 11 is guided as it is rotationally driven in the direction indicated by an arrow mark. Further, not only does the film guide 13 hold the heater 12, but the film guide 13 also prevents the heat generated by the heater 12 from dissipating in the opposite direction from the nip N. The film guide 13 is formed of heat resistant resin, such as liquid polymer, phenol resin, PPS, PEEK, or the like.

The pressure roller 20 is made up of a metallic core 21, an elastic layer 22, and a release layer. The metallic core 21 is made of a metallic substance, such as SUS, SUM, Al, or the like. The elastic layer 22 is formed on the peripheral surface of the metallic core 21, and is formed of a heat resistant rubber, such as silicone rubber, fluorine rubber, or the like, or foamed silicone rubber. The release layer is formed on the elastic layer 22, and is formed of PFA, PTFE, FEP, or the like. In this embodiment, the pressure roller 20 is 20 mm in external diameter. The elastic layer 22 is formed of silicone rubber, and is 3.5 mm in thickness. The dimension of the elastic layer 22 in terms of the lengthwise direction of the pressure roller 20 is 230 mm. Further, the pressure roller 20 is kept pressured toward the above-mentioned heating member 10 by the pressure applied to its lengthwise ends by an unshown pressure applying means to form the nip N, which is necessary for the thermal fixation of the toner image, between itself and the outward surface of the film 11. Further, the pressure roller 20 is rotationally driven from the one of the lengthwise ends of its metallic core 21 by an unshown driving means. Thus, the film 11, which is loosely fitted around the film guide 13, is rotated by the friction which occurs between the film 11 and the pressure roller 20 as the pressure roller 20 is rotationally driven.

The heater 12, as a film heating member, has a substrate, a pair of heat generating resistors formed on the top and back surfaces of the substrate, one for one, in a preset pattern, and a pair of surface protection layers which cover the heat generating resistors, one for one. The heater 12 is held to the film guide 13.

Part (a) of FIG. 3 is a schematic plan view of the bottom side (on which film 11 does not slide) of the heater 12. Part (b) of FIG. 3 is a schematic plan view of the back side (on which film 11 slides) of the heater 12. Part (c) of FIG. 3 is a schematic sectional view of the heater 12 at a plane x-x' in part (a) or part (b) of FIG. 3.

First, referring to part (b) of FIG. 3, the structure of the top side of the heater 12 is described. A substrate 301 is made of a heat resistant and insulative ceramic, such as $Al_2O_2$ (alumina), AlN (aluminum nitride), or the like. In this embodiment, the substrate 301 is made of $Al_2O_2$. The substrate 301 is 10 mm in width, 270 mm in length, and 1 mm in thickness. The substrate 301 has a larger heat generating resistor 309, as the first heat generating member, on the front surface (first surface) of the substrate 301. The first surface of the substrate 301 is the surface of the substrate that faces the inward surface of the film 11.

The heat generating resistor 309 is formed on the substrate 301 by coating the first surface of the substrate 301 with a compound which contains an electrically conductive agent, such as Ag/Pd (silver/palladium), $RuO_2$ (Ruthenium oxide), or the like, or glass, polyimide, etc., with the use of screen printing, to a thickness of roughly 10 μm. More specifically, the heat generating resistor 309 has two heat generating sections and a connective section 307 by which the two heat generating sections are electrically connected to each other by their lengthwise end. The two heat generating sections are formed in parallel to each other on the substrate 301 and are 225 mm in length and 1.5 mm in width. An interval of 3.0 mm is provided between the two heat generating sections. The two heat generating sections are connected in series by the connective section 307, which is lower in electrical resistance than the heat generating sections, making the heat generating resistor 309 roughly U-shaped. In this embodiment, the resistance value of the heat generating resistor 309 is 12Ω. Incidentally, the reason why the larger heat generating resistor, which is for a sheet of recording paper of the larger size, is made to be 225 mm in length is to enable the fixing device 7 to heat the toner image formed on a largest sheet of recording medium usable with the apparatus, which may be a sheet of recording paper of size A4 (210 mm in width).

A referential numerical code 310 stands for a conductive member for supplying the heat generating resistor 309 with electric power. A referential numerical code 320 stands for a power supply contact, as a point of contact, through which the heat generating resistor 309 is supplied with electric current. As the material for the connective member 307, the conductive member 310, and the power supply contact 320, a substance which is lower in electrical resistance than the heat generating resistor 309 is used. In this embodiment, the connective member 307, the conductive member 310, and the power supply contact 320 are formed by applying a paste which contains a mixture of Ag (silver) powder and Pt (platinum) power, to the substrate 301 by screen-printing. The heat generating resistor 309 is covered with a surface protection layer 308, which is for electrically insulating the heat generating resistor 309, and for making the heat generating resistor 309 resistant to the friction which occurs between the heater 12 and film 11. In this embodiment, the surface protection layer 308 is formed of glass, and is 65 μm in thickness.

Next, referring to part (a) of FIG. 3, the structure of the back side of the heater 12 is described. The back side, or the other side (second surface), of the substrate 301 is provided with a heat generating resistor 305, as the second heat generating member, for the smaller sheet of paper. The second surface of the substrate 301 is the opposite surface of the substrate 301 from the first surface of the substrate 301. The heat generating resistor 305 is formed by screen-printing a heat generating resistor, which is similar to the heat generating resistor for the larger sheet of paper, on the second surface of the substrate 301. The heat generating resistor 305 is made up of a pair of heat generating sections which are positioned in parallel with the presence of 30 mm gap between them. The two heat generating sections are 15 mm in length and 1.5 mm in width. The two heat generating sections are serially connected by an electrically connective member 304, which is smaller in resistance value than the two heat generating sections, in such a pattern that the heat generating resistor 305 becomes U-shaped like the heat generating resistor 309. In this embodiment, the resistance value of the heat generating resistor 305 is set to 25Ω. By the way, the reason why the heat generating resistor 305 is made to be 115 mm in length is to enable the fixing device 7 to heat a toner image formed on a smaller sheet of paper, such as an official postcard (100 mm in width) and a sheet of paper of size A6 (105 mm in width) without heating the out-of-sheet-path portions of heating film 11.

A referential numerical code 306 stands for an electrically conductive member for supplying the heat generating resistor 305 for a smaller sheet of paper with electric power. A referential numerical code 321 stands for a power supply contact as a connector for supplying the heat generating resistor 305 with electric current. In this embodiment, the connective member 304, the conductive member 306, and the power supply contact portion 321 are formed by screen-printing each in a preset pattern, using paste which contains a mixture of Ag (silver) and Pt (platinum). A referential numerical code 302 stands for a surface protection layer formed of glass, which is 65 μm in thickness, like the surface protection layer 308.

Next, the temperature control in this embodiment is described. The fixing device 7 obtains the most appropriate amount of heat for fixing a toner image to a sheet of a recording medium, by maintaining the temperature of the heater 12 at a preset level. The heater 12 is controlled in temperature by controlling the amount by which electric power is supplied to the heater 12, in such a manner that the temperature level detected by a temperature detection element 14 (which hereafter will be referred to as "back thermistor"), as a temperature detecting means that is disposed on the heater 12, reaches and remains at a preset level, in order to indirectly control the film 11 in temperature. The signals outputted by the back thermistor 14 are inputted into a CPU 52 as the means for determining the amount by which power is supplied to a relevant heat generating resistor by the power supplying portion. Based on these input signals, the CPU 52 selectively controls the power supply to the heat generating resistors 305 and 309 of the heater 12 through a pair of triacs 50 and 51, respectively, as a power supply driving means of the power supply controlling portion, so that the temperature of the heater 12 reaches, and remains at, a preset target level. In this process, the power supply to the heat generating resistors 305 and 309 is controlled by turning on or off the AC voltage applied from a commercial AC power source 54. As the method for controlling the power supply, frequency control or phase control is used. By controlling the power-on ratio, the heater 12 is minimized in temperature fluctuation.

In this embodiment, phase control is used as the method for controlling the power supply, for the following reason. In phase control, the AC voltage to be inputted is controlled by the power-on angle in each wave of the AC voltage to be inputted. Not only can phase control precisely control the power-on ratio, but also, phase control can restore the power-on ratio to a minimum of one full wave. Therefore, not only can phase control accurately control the power-on ratio, that is, renewal of electric power, but phase control can also minimize the temperature ripples of the heater 12 attributable to the control. In the case of phase control, the phase angle α is preset in relation to the power-on ratio D (%), and the CPU 52 controls the heater 12 based on a control table, such as Table 1.

(Table 1) Relationship Between Heater-Power-Ratio and Phase Angle

TABLE 1

| Power-on ratio | Phase angle α (deg.) |
|---|---|
| 100 | 0 |
| 97.5 | 28.56 |
| . | . |
| . | . |
| . | . |
| 75 | 66.17 |
| . | . |
| . | . |
| . | . |
| 50 | 90 |
| . | . |
| . | . |
| . | . |
| 25 | 113.83 |
| . | . |
| . | . |
| . | . |
| | 151.44 |
| 0 | 180 |

By the way, frequency control, or hybrid control, which is a combination of phase control and frequency control, may be used as the method for controlling the power delivery to the heater.

In frequency control, the heater 12 is turned on or off with intervals, the length of which is equal to half a wave of an AC power source. That is, the power is supplied to the heater 12 at a preset power-on ratio by changing the ratio of the number of half-waves during which the power is delivered to the heater, relative to the number of half-waves during which the power is not delivered to the heater. For example, in a case in which each control cycle comprises eight half-waves, and the power-on ratio D is 50%, both the number of the half-waves during which the power is supplied to the heater 12, and the number of the half-waves during which the power is not supplied to the heater 12, are four. As for the a power delivery pattern, that is, to which half-waves the power is supplied among the eight half-waves in each control cycle power, multiple patterns may be prepared so that a proper pattern can be selected according to the power-on ratio in the preceding and following control cycles. That is, the CPU 52 controls the heater 12 with the use of a control table which shows the relationship between the power-on ratio and power supply pattern. In frequency control, the heater 12 is turned on or off for every half-wave, and therefore, it is unlikely for high frequency current to be generated. Thus, from the standpoint of preventing the occurrence of high frequency current, frequency control is advantageous compared to phase control. On the other hand, phase control is smaller in current fluctuation than frequency control. Therefore, it is advantageous compared to frequency control, from the standpoint of minimizing an illuminating device in flickering.

In the case of hybrid control, the heater 12 is controlled in power-on ratio with the use of a power supply pattern that shows which half-waves are supplied with power by frequency control, and which half-waves are supplied with power by phase control. Also, in the case of hybrid control, the CPU 52 controls the heater 12 with the use of a control table that shows the relationship between the power-on ratio and the power supply pattern. Compared to a case in which the heater 12 is controlled with the use of only phase control, hybrid control can better prevent the occurrence of high frequency current and switching noises. Further, compared to a case in which the heater 12 is controlled with the use of only frequency control, hybrid control can reduce flickering more effectively. In other words, hybrid control can control the power supply to the heater 12 in a greater number of steps than frequency control or phase control.

In this embodiment, PID control (Proportional-Integral-Differential Control) was used as the method for calculating the power-on ratio. In PID control, the power-on ratio is determined with the use of the following equation, in which D stands for power-on ratio, and e stands for the difference between the target temperature level and the temperature level detected by the thermistor on the back surface of heater 12. The equation includes also three parameters, more specifically, a proportion gain Kp, an integration time Ti, and a differentiation time Td:

$$D=Kp(e+1/Ti\cdot\int edt+Td\cdot de/dt) \quad (1)$$

Here, the differences between the target temperature level and the temperature level detected by the thermistor 14 are e(n), e(n−1) and e(n−2), sequentially listing from the earliest one. Thus, the relationship among the current power-on ratio D(n), power-on ratio D(n−1), and power-on ratio D(n−2) can be expressed in the form of Equation (1), in which Ts stands for the length of sampling time:

$$D(n)=D(n-1)+Kp\{e(n)-e(n-1)\}+Kp\cdot Ts/Ti\cdot e(n)+Kp\cdot Td/Ts\cdot\{e(n)-2e(n-1)-e(n-2)\} \quad (2)$$

If Ki_Kp·Ts/Ti, and Kd_Kp·Td/Ts, Equation (2) becomes as follows:

$$D(n)=D(n-1)+Kp\{e(n)-e(n-1)\}+Ki\cdot e(n)+Kd\{e(n)-2e(n-1)-e(n-2)\}$$

Ki stands for integration gain, and Kd stands for differentiation gain.

That is, the power-on ratio D(n) is determined by adding the following three components to the preceding power-on ratio D(n−1):

Amount of proportional control: Kp {(e(n)−e(n−1)}

Amount of integration control: Ki·e(n)

Amount of differentiation control: Kd{e(n)−2e (n−1)−e (n−1)}

In this embodiment, the speed at which a letter size sheet (216 mm in width) of recording paper, which is the same width as the largest sheet of recording paper conveyable through the fixing device 7, is conveyed through the fixing device 7 is 180 mm/sec. The number of prints which can be outputted by the image forming apparatus per minute is 30 ppm. In such a case, power is supplied to only the heat generating resistor 309, which is on the front surface of the heater 12. The target temperature level for the thermistor 14 is set to 200° C. for satisfactory fixation. In comparison, the speed at which a sheet of recording paper of size A6 (100 mm in width), which is a smaller sheet (which in this embodiment is no more than 110 mm in width) of recording paper is conveyed is 180 mm/sec, and the number of prints outputted per minute is 20 ppm. In this case, power is supplied to only the heat generating resistor 305, which is on the back surface of the heater 12. The target temperature level for the thermistor 14 is set to 200° C.

Characteristic of this Embodiment

Next, what characterizes this embodiment is described. What characterizes this embodiment is that the method for determining the amount by which power is supplied to the first heat generating member is made different from that for the second heat generating member. In this embodiment, the values of the parameters Kp, Ki and Kd for PID control, which are used when power is supplied to the heat generating resistor 309, that is, the one on the front surface of the heater 12, are made different from those when power is supplied to the heat generating resistor 305, that is, the one on the back surface of the heater 12.

In the following description of the characteristics of this embodiment, Kp1, Ki1, and Kd1 stand for parameters for the proportional control, integral control, and differential control, respectively, when power is supplied to only the heat generating resistor 309, which is on the front surface of the heater 12. Kp2, Ki2, and Kd2 stand for parameters for the proportional control, integral control, and differential control, respectively, when power is supplied to the heat generating resistor 305, which is on the back surface of the heater 12. In this embodiment, the values for these parameters are set to satisfy the following inequalities:

$$Kp1<Kp2$$

$$Ki1>Ki2$$

$$Kd1<Kd2$$

The values for Kp, Ki and Kd are determined based on the amount of thermal resistance and thermal capacity of the portion of the heater 12 which is between the heat generating resistor on the front surface of the heater 12 to the thermistor 14, and the amount of thermal resistance and thermal capacity of the portion of the heater 12 which is between the heat generating resistor on the back surface of the heater 12 and the thermistor 14, recording paper conveyance speed, and the like factors. Therefore, it is desired that the values for the Kp, Ki and Kd are set so that the temperature detected by the thermistor 14 converges to the target level as soon as possible.

In this embodiment, while power is supplied to the heat generating resistor 309, which is on the front surface of the heater 12, the heat generated by the heat generating resistor 309 reaches the thermistor 14 through the substrate 301 and surface protection layer 302. On the other hand, while the power is supplied to the heat generating resistor 305, which is on the back surface of the heater 12, the heat generated by the heat generating resistor 305 reaches the thermistor 14 through only the surface protection layer 302. Therefore, while power is supplied to the heat generating resistor 309, which is on the front surface of the heater 12, the portion of heater 12, which is between the heat generating resistor and thermistor 14, that is, the heat transmission passage, is greater in thermal resistance and thermal capacity than while power is supplied to the heat generating resistor 305, which is on the back surface of the heater 12, because the heat transmission passage while power is supplied to the heat generating resistor 309 includes the substrate 301 as well as the surface protection layer 302. Therefore, while power is supplied to the heat generating resistor 309 which is on the front surface of the heater 12, the length of time it takes for the heat to conduct to the thermistor 14 is longer than when power is supplied to only the heat generating resistor 305. In a case where the length of time it takes for the heat generated by the heater 12 to conduct to the thermistor is longer as in the case where power is supplied to only the heat generating resistor 309 as described above, even if the heater 12 is increased in the power-on ratio D, it takes a significant length of time for the thermistor 14 to detect the increase in the temperature of the heater 12, and therefore, the amount by which the temperature level detected by the thermistor 14 changes as the amount by which power is supplied to the heater 12 is changed becomes larger. Therefore, in cases where the length of time it takes for the heat from the heat generating resistor to conduct to the thermistor 14 is long, and the proportional gain Kp or differential control parameter Kd (differentiation gain) is large, the results of the calculation of power-on ratio D in PID control is likely to fluctuate. Consequently, the temperature level detected by the thermistor 14 is likely to overshoot or undershoot, making it therefore likely to take longer for the detected temperature level to converge to the target level. Further, in a case where the length of time it takes for the heat generated by the heat generating resistor to conduct to the thermistor 14 is long, and the integration parameter (integration gain) Ki is small in value, it takes a substantial length of time for the value of the integral control to become satisfactorily large, and therefore, it is likely to take a substantial length of time for the temperature level detected by the thermistor 14 to reach the target level.

In this embodiment, therefore, the value for each of the parameters for PID control was set as follows, in consideration of the characteristics of the fixing device 7 such as those described above:

Kp1=2.0, Ki1=1.0, Kd1=1.0

Kp2=3.0, Ki2=0.6, Kd2=2.0

Shown in part (a) of FIGS. 4-4(*c*) are the relationships between the changes in the temperature of the film 11 and the changes in the power-on ratio D, in a case where the temperature controlling method in this embodiment was used, and in a case where the comparative temperature controlling method was used. In the case of the comparative controlling method, the temperature of the thermistor 14 was controlled with the parameters Kp and Ki for PID control being fixed in value (Kp1=Kp2=3.0, Ki1=Ki2=0.6, and Kd1=Kd2=2.0), regardless of whether power is supplied to the heat generating resistor on the front or back surface of the heater 12.

Part (a) of FIG. 4 corresponds to a case where power is supplied to the heat generating resistor 309, that is, the one on the front surface of the heater 12, and a sheet of paper of size A6 (80 g/m$^3$) was conveyed through the fixing device 7.

Part (b) of FIG. 4 corresponds to a case where power is supplied to heat generating resistor 305 which is on the back surface of the heater 12, and a sheet of recording paper of the letter size (80 g/m$^3$ in basis weight) was conveyed through the fixing device 7.

Part (c) of FIG. 4 corresponds to the comparative case where power is supplied to only the heat generating resistor 305 which is on the back surface of the heater 12, and a sheet of recording paper of the letter size was conveyed though the fixing device 7.

Referring to part (a) of FIG. 4, in a case where power was supplied to only the heat generating resistor 309 which is on the front surface side of the heater 12, the power-on ratio D did not fluctuate, and the temperature of the thermistor 14 was properly controlled. However, in a case where power was supplied to only the heat generating resistor 305 which is on the back surface of the heater 12, and the comparative method was used, the power-on ratio D fluctuated, and therefore, the temperature of the thermistor 14 also fluctuated, as shown in Figure (c). In comparison, in this embodiment, even while power was supplied to the heat generating resistor 305 which is on the back surface of the heater 12, the power-on ratio did not fluctuate, and the temperature of the film 11 was properly controlled, as shown in part (b) of FIG. 4.

As described above, with the use of the heater controlling method in this embodiment, it is possible to prevent the temperature of the heating film 11 from fluctuating up or down, that is, it is possible to properly control the temperature of the heating film 11 (temperature of heating film 11 can be precisely kept at target level), regardless of whether power is supplied to the heat generating resistor on the front surface of the heater 12, or on the back surface of the heater 12.

By the way, in this embodiment, PID control was used. However, PI control or PD control may be used, as long as the film temperature can be reliably controlled. That is, all that is necessary is that among the above-described three inequalities (Kp1<Kp2, Ki1>Ki2, and Kd1<Kd2), at least one of them is satisfied. Similarly, as long as the film temperature can be reliably controlled, any control that can satisfy at least one of the above-described three inequalities may be used.

Further, in this embodiment, in order to control the temperature of the film 11, the power-on ratio for the heater 12 was calculated with the use of PID control. However, this embodiment is not intended to limit the present invention in scope. Any method will do as long as it can keep the film temperature stable at a desired level, regardless of whether power is supplied to the heat generating resistor on the front or back surface of the heater 12. For example, it may be "on-off control". That is, the power to the heater 12 may be simply turned on or off.

In "on-off" control, power is supplied to the heater 12 by either 0% or 100%. If the temperature level detected by the temperature detecting means is higher than the target level, no power is supplied to the heater 12, whereas if it is lower than the target level, power is supplied to the heater 12 by 100%. In "on-off" control, if the length of time it takes the heat generated by a heat generating resistor is relatively long as when power is supplied to the heat generating resistor on the front surface of the heater 12, the length of time for sampling the temperature of the heating film 11 is made relative long. On the other hand, if the length of time it takes for the heat generated by a heat generating resistor to reach the thermistor 14 is relatively long as in a case where power is supplied to the heat generating resistor on the back surface of the heater 12, the length of time for sampling the temperature of the film 11 is made relatively short. By controlling the film heating means in this manner, even in a case where "on-off" control is used, it is possible to keep the film temperature stable at a desired level, regardless of whether power is supplied to the heat generating resistor on the front or back surface of the heater 12. These arguments apply also to the following embodiments of the present invention.

Embodiment 2

Next, the image forming apparatus in the second embodiment of the present invention is described. The basic structure and operation of the fixing device in this embodiment are the same as those of the fixing device in the first embodiment. Therefore, the components of the fixing device in this embodiment, which are the same as, or equivalent to, the counterparts in the first embodiment, in function and structure, are given the same referential codes as those given to the counterparts, and are not described here. That is, this embodiment is described only about the characteristics of this embodiment, which makes this embodiment different from the first embodiment.

In the following description of this embodiment, a method for precisely keeping the temperature of the heating film 12 at a target level, regardless of whether power is supplied to the heat generating resistor on the front surface or back surface of the heater 12, even if the temperature detection element is on the inward side of the loop (film loop) which the heating film forms.

FIG. 5 is a sectional view of the fixing device 7 in this embodiment. A numerical referential code 15 stands for the temperature detection element, which is disposed on the inward side of the loop which the heating film forms. Hereafter, this temperature detection element will be referred to simply as "inward thermistor". This inward thermistor 15 is different in position from the thermistor 14 in the first embodiment. It is disposed in the inward side of the film loop, being 25 mm downstream from the center of the heater 12 in terms of the recording paper conveyance direction. It is disposed so that it is positioned above the film guide 13, and elastically contacts the inward surface of the film 17. It bears the function of detecting the temperature of the inward surface of the film 17. More concretely, the inward thermistor 15 is attached to the tip of a stainless steel arm 16 fixed to the film guide 13. Since the arm 16 is elastic, the inward thermistor 15 remains in the state in which it is always kept in contact with the inward surface of the film 17. With the use of an inward thermistor such as the above-described thermistor 15, it is possible to directly control the temperature of the film 17 so that it is assured that the film temperature remains at the proper level. Further, compared to the method for controlling the film temperature by disposing the temperature detection element on the heater 12 as in the first embodiment, the method in this embodiment can more precisely control the film temperature, and therefore, is less likely to be affected by the basis weight of a sheet of recording paper which is being conveyed through the fixing device, and/or the amount of the toner on the sheet of recording paper per unit area of the sheet. In this embodiment, therefore, the fixing device 7 is structured so that while a sheet of recording paper is conveyed through the fixing device 7, the film temperature is kept stable at a desired level by controlling the heater with the use of the inward thermistor 15 which is in contact with the inward surface of the film 17.

The film 17 in this embodiment is made up of a substrative layer formed of SUS, an elastic layer form of silicone rubber in a manner to cover the substrative layer, and a release layer formed of a piece of PFA tube. The reason why SUS is used as the material for the substrative layer of the film 17 is to ensure that the inward thermistor 15 always remains in contact with the inward surface of the film 17. If polyimide is used as the material for the substrative layer of the film 17 as it was used the substrative layer of the film 11 in the first embodiment, which was 65 μm in thickness, the film 17 becomes substantially less rigid. Thus, if the fixing device 7 is structured so that the inward thermistor 15 is elastically pressed upon the inward surface of the film 17 by the resiliency of the arm 16, the film 17 is made to outwardly bulge by the resiliency of the arm 16, making it therefore possible that the inward thermistor 15 will fail to remain desirably in contact with the inward surface of the film 17. In comparison, SUS is substantially higher in rigidity than polyimide. Therefore, in a case where SUS is used as the material for the film 17, the film 17 is unlikely to be deformed by the resiliency of the arm 16. Therefore, the inward thermistor 15 is likely to remain in contact with the inward surface of the film 17.

The heater 12 in this embodiment is practically the same in structure as the fixing device 7 in the first embodiment described with reference to parts (a), (b) and (c) of FIG. 3. The only difference in structure between the heater 12 in this embodiment and the heater 12 in the first embodiment is the thickness of the substrate 301. In this embodiment, the substrate 301 is given a thickness of 0.6 mm in order to increase it in the speed of thermal conduction. Reducing the substrate 301 in thickness makes it easier for the heat generated by the heat generating resistor 309, which is on the front surface of the substrate 301, to conduct to the back surface of the substrate 301. However, reducing the substrate 301 in thickness makes it likely for the substrate 301 to be fractured by thermal stress. Therefore, the thickness for the substrate 301 has to be carefully determined in consideration of the thermal conductivity of the substrate 301 and the possibility that the substrate 301 will be fractured by thermal stress.

Also in this embodiment, the parameters Kp, Ki and Kd for PID control were changed in value depending on whether power is supplied to the heat generating resistor 309 on the front surface of the heater 12 or the heat generating resistor 305 on the back surface of the heater 12.

In this embodiment, the parameters for the PID control are set to satisfy the following inequities in which Kp3 stands for the proportional control amount while power is supplied to the heat generating resistor 309, that is, the heat generating resistor on the front surface of the heater 12; Ki3, parameter related to the amount of integral control; and Kd3 stands for the amount of differential control. Also in the following inequities, Kp4 stands for the parameter related to the amount of proportional control while power is supplied to the heat generating resistor 305, that is, the heat generating resistor on the back surface of the heater 12; Ki4, parameter related to the amount of integral control; and Kd4 stands for the parameter related to the amount of differential control:

$$Kp3>Kp4$$

$$Ki3<Ki4$$

$$Kd3>Kd4$$

While power is supplied to the heat generating resistor 309, that is, the heat generating resistor on the front surface of the heater 12, the heat generated by the heat generating resistor 309 reaches the front surface of the heater 12 through the surface protection layer 308. Then, as the film 17 heated by the heater 12 is rotationally moved, the heat from the heat generating resistor 309 reaches the inward thermistor 15. In comparison, while power is supplied to the heat generating resistor 305, that is, the heat generating resistor on the back surface of the heater 12, the heat generated by the heat generating resistor 305 reaches the thermistor 14 through the substrate 301 and surface protection layer 308. Then, the heat generated by the heater 12 reaches the inward thermistor 15 as the film 11 is rotationally moved. Therefore, the portion of the heater 12, through which the heat generated by the heater 12 has to conduct to each the inward thermistor 15 while the power is supplied to the heat generating resistor 305, that is, the one on the back surface of the heater 12, is greater in thermal capacity and thermal resistance than while the heat is generated by the heat generating resistor 309, that is, the one on the front surface of the heater 12, because, while power is supplied to the heat generating resistor 309, the heat generated by the heater 12 has to conduct through the substrate 301 to reach the inward thermistor 15. Then, while power is supplied to the heat generating resistor 309 on the back surface of the heater 12, the length of time it takes for the heat generated by the heater 12 to reach the inward thermistor 15 is longer than while power is supplied to only the heat generating resistor 309.

In this embodiment, therefore, it is desired that while power is supplied to the heat generating resistor 309, that is, the one on the front surface of the heater 12, the parameter Kp for the proportional control, and parameter Kk for the differential control are made smaller in value, and the parameter Ki for the integral control is made greater in value. Thus, in this embodiment, the values for the parameters for PID control are set as follows:

Kp3=2.0, Ki3=0.6, Kd3=2.0

Kp4=1.0, Ki4=1.0, Kd4=1.0

By setting the values for the parameters for PID control as described above, it is possible to prevent the temperature level detected by the temperature detection element from deviating up or down relative to the target level, regardless of whether power is supplied to the heat generating member on the front or back surface of the heater 12, even in a case where the temperature detection element is disposed on the inward side of the heating film loop. That is, it is possible to precisely keep the temperature of the film 17 at a desired level. Therefore, it is possible to prevent the occurrence of such fixation failure as "hot offset" or "cold offset".

Embodiment 3

Next, the image forming apparatus in the third embodiment of the present invention is described. The basic structure and operation of the fixing device in this embodiment are the same as those of the fixing device in the second embodiment. Therefore, the elements of the fixing device in this embodiment, which are the same as, or equivalent to, the counterparts of the fixing device in the second embodiment, are given the same referential codes as the counterparts, and are not described in detail here. That is, this embodiment is described only about what makes this embodiment different from the preceding embodiments.

FIG. 6 is a sectional view of the fixing device 7 in this embodiment, The fixing device 7 in this embodiment has a thermistor 14 in addition to the inward thermistor 15. In this embodiment, while power is supplied to only the heat generating resistor 309, that is, the one on the front surface of the heater 12, the power-on ratio is controlled with the use of the inward thermistor 15 so that the heat film temperature reaches a target level, and remains at the target level. In comparison, while power is supplied to only the heat generating resistor 305, that is, the one on the back surface of the heater 12, the power-on ratio is controlled with the use of the thermistor 14 so that the heating film temperature reaches, and remains at, the target level.

That is, in this embodiment, the fixing device 7 is provided with the inward thermistor 15, as the first temperature detection element, which detects the temperature of the heating film 17, while power is supplied to the heat generating resistor 309, as the first heating member. It is provided with also the thermistor 14, as the second temperature detection element, which detects the temperature of the heating film 17 while power is supplied to only the heat generating resistor 305 as the second heat generating member. The portion of the heater 12, through which the heat generated by the first heat generating member has to conduct to reach the first temperature detection element is smaller in thermal resistance and thermal capacity than the portion of the heater 12, through which the heat generated by the second heating member has to conduct to reach the first temperature detection element. Thus, by structuring the fixing device 7 so that which of the two temperature detection elements is to be used is determined based on while of the two heat generating members is used, it is possible to control the heating film temperature at a higher level of accuracy.

As stated in the description of the second embodiment given above, from the standpoint of precisely controlling the heating film temperature, it is desired that the inward thermistor 15 is used to control the temperature of the film 17, regardless of whether power is supplied to the heat generating resistor on the front or back surface of the heater 12. By the way, if the substrate 301 of the heater 12 is relatively thick, for example, and therefore, the length of time it takes for the heat generated by the heater 12 to conduct to the inward thermistor 15 is relatively long. That is, it takes a relatively long time for the inward thermistor 15 to detect the increase/decrease in the temperature of the film 17 attributable to the increase/decrease in power-on ratio when the fixing device 7 is increased or reduced in power-on ratio. Therefore, it is rather difficult for the system for controlling the temperature of the film 17 to deal with sudden change in the film temperature. Consequently, the film temperature fluctuates relative to the target level, which possibly causes the image forming apparatus to output defective images.

part (a) of FIGS. 7-7(*c*) show the relationship between the changes in the temperature level detected by the thermistor, and the changes in the power-on ratio, when the heating film of the fixing device 7 in this embodiment, and the heating film in the comparative fixing device, were controlled in temperature. They show the changes made to the power-on ratio, and the resultant changes which occurred to the temperature of the heating film, while power was supplied to the heat generating resistor 305, that is, the one on the back surface of the heater 12, the substrate 301 of which was 1 mm in thickness.

Part (a) of FIG. 7 is related to this embodiment, and shows the temperature of the film 17 and power-on ratio while power was supplied to the heat generating resistor 305, that is, the one on the front surface of the heater 12 and the film temperature was controlled based on the heating film temperature detected with the use of the inward thermistor 15.

Part (b) of FIG. 7 also is related to this embodiment, and shows the temperature of the film 17 and power-on ratio while power was supplied to the heat generating resistor 309, that is, the one on the front surface of the heater 12 and the film temperature was controlled based on the heating film temperature detected with the use of the inward thermistor 15.

Part (c) of FIG. 7 is related to the comparative fixing device, and shows the temperature of the film 17 and power-on ratio while power was supplied to the heat generating resistor 309, that is, the one on the front surface of the heater 12 and the film temperature was controlled based on the heating film temperature detected with the use of the inward thermistor 15.

Referring to part (a) of FIG. 7, while power is supplied to only the heat generating resistor 305, that is, the one on the back surface of the heater 12, and the film temperature was controlled with the use of the inward thermistor 15, no fluctuation was seen in the power-on ratio, and the temperature of the film 17 was properly controlled. However, in the case of the comparative fixing device, while power was supplied to only the heat generating resistor 309, that is, the one on the front surface of the heater 12, and the film temperature was controlled with the use of the inward thermistor 15, the power-on ratio fluctuated, and therefore, the temperature of the film 17 also fluctuated, as shown in part (c) of FIG. 7. In comparison, in this embodiment, the thermistor 14 was used to control the film temperature, and no fluctuation was seen in power-on ratio, and the temperature of the film 17 was properly controlled, as shown in part (b) of FIG. 7.

As described above, in a case where the length of time it takes for the heat generated by the heat generating member on the back surface of the heater 12 to conduct to the inward thermistor 15 is relatively long, the temperature of the film 17 can be kept at the target level by using the thermistor 14, which is shorter in the length of time it takes for the heat generated by the heat generating member on the back surface of the heater 12 to reach the temperature detection element than the inward thermistor 15. Thus, it is possible to prevent the occurrence of the phenomenon that the temperature of the film 17 fluctuates up and down, and therefore, it is possible to prevent the image forming apparatus from outputting prints which suffer from such fixation failure as "hot-offset" and "cold-offset".

Embodiment 4

Next, the image forming apparatus in the fourth embodiment of the present invention is described. The basic structure and operation of the fixing device in this embodiment are the same as those of the fixing device in the third embodiment. Therefore, the elements of the fixing device in this embodiment, which are the same as, or equivalent to, the counterparts in the fixing device in the third embodiment are given the same referential codes as those given to the counterparts, and are not described in detail here. That is, this embodiment is described regarding what makes this embodiment distinctive from the preceding embodiments. These arguments apply to the following embodiments as well.

In the third embodiment, while power is supplied to only the heat generating resistor on the back surface of the heater 12, it was better to use the thermistor 14 in order to keep the temperature of the film 17 stable at the target level, as described above. On the other hand, if the inward thermistor 15 is used to control the temperature of the film temperature while power is supplied to only the heat generating resistor on the back surface of the heater 12, the temperature of the film 17 is likely to fluctuate up and down relative to the target level. In this embodiment, therefore, in a case where the thermistor 14 is used to control the power-on ratio in order to keep the film temperature stable at the target level, the target level for the temperature detected by the thermistor 14 is adjusted according to the temperature level detected by the inward thermistor 15. That is, in a case where the power to be supplied to the heat generating resistor 305, as the second heat generating member, is controlled, not only the temperature of the heater 12 is detected by the thermistor 14 as the second temperature detection element, but also, by the inward thermistor 15 as the first temperature detection element. That is, the power to be supplied to the second heat generating member is controlled so that the temperature level detected by the second temperature detection element is kept at the adjusted target level, which is obtained by adjusting the target temperature level for the second temperature detection element by the difference between the temperature level detected by the first temperature detection element and the target temperature level for the first temperature detection element. Next, a method, in this embodiment, for preventing the temperature of the film 17 from fluctuating up and down, by this adjusted target temperature level, so that the temperature of the film 17 can be more precisely controlled, is described.

In this embodiment, in a case where the heater 12 is controlled in power-on ratio so that the temperature level detected by the thermistor 14 converges to the target level, the target temperature level for the thermistor 14 is adjusted according to the difference between the temperature level detected by the inward thermistor 15 and the target temperature level set for the inward thermistor 15. By the way, the image forming apparatus is structured so that the target temperature levels Ta and Tb for the thermistor 14 and inward thermistor 15, respectively, are stored in an unshown nonvolatile memory, and these data are read out by CPU 52 as necessary.

As a small sheet of recording paper begins to be conveyed through the image forming apparatus in this embodiment, power is supplied to only the heat generating resistor 305, that is, the one on the back surface of the heater 12, with the target temperature level for the temperature detected by the thermistor 14 set to Ta. Then, the power to be supplied to the heater 12 is controlled so that the temperature level detected by the thermistor 14 converges to the target level Ta. Meanwhile, the film temperature is detected by the inward thermistor 15, and the difference between the temperature level detected by the thermistor 14 and that by the inward thermistor 15 is calculated. As soon as the trailing edge of the small sheet of paper comes out of the fixation nip N, the value for Tcom is selected from Table 2 which shows the relationship between the difference Tmd between the detected two temperature levels and the adjusted temperature level Tcon. Then, the target level Ta for the temperature detected by the thermistor 14 is adjusted to Ta+Tcon. Table 2 shows the relationship between temperature difference Tmd and temperature adjustment amount Tcon.

TABLE 2

| Tmd (° C.) | Tcoon |
|---|---|
| +6 | −6 |
| +4 | −4 |
| +2 | −2 |
| 0 | 0 |
| −2 | +2 |
| −4 | +4 |
| −6 | +6 |

By the way, in this embodiment, the image forming apparatus is structured so that the table which shows the relationship between the temperature difference Tmd and temperature adjustment amount Tcon is stored in the above-described nonvolatile memory, and the data in the memory are read by the CPU 52 as necessary. The values for the amount Tmd of temperature level difference and the temperature adjustment amount Tcon do not need to be limited to those given in Table 2. For example, if it is desired that the temperature level detected by the inward thermistor 15 reaches the target level sooner, all that is necessary is to increase the temperature adjustment amount Tcon. Further, the temperature adjustment amount has only to be set as necessary according to the structure of the fixing device and/the condition under which a sheet of recording paper is conveyed through the fixing device.

In this embodiment, in order to ensure that the fixing device remains stable in performance while each sheet of recording paper is conveyed through the fixing device, the target temperature level T2 is adjusted while no sheet of recording paper is in the fixation nip N. That is, in an image forming operation in which multiple sheets of recording paper are continuously conveyed through the image forming apparatus, the target temperature level Ta is adjusted during a period between when the preceding one of the successively conveyed two sheets of recording paper comes out of the fixation nip N and when the following sheet of recording paper reaches the fixation nip N.

As described above, in a case where the heater 12 is controlled in the power-on ratio to make the temperature level detected by the thermistor 14 converge to the target level, using the method, in this embodiment, for controlling the temperature of the heating film 11 makes it possible to more precisely control the temperature of the film 11.

Embodiment 5

In the fifth embodiment of the present invention, the thermistor to be used for the temperature control is switched according to the recording paper conveyance speed, and to which heat generating resistor power is supplied, in order to ensure that even in a case where the image forming apparatus is changed in recording medium conveyance speed, the heating film temperature is properly controlled. Next, the method, in this embodiment, for controlling the heating film temperature is described.

The image forming apparatus in this embodiment is enabled to convey a sheet of recording medium at one of two different speeds, that is, 180 mm/sec (which hereafter is referred to as "full-speed") which is the normal speed, and 90 mm/sec (which is referred to as "half-speed", hereafter). The half-speed is used when sheets of recording paper which are large in basis weight or thermal capacity are used as recoding medium. It is for increasing the amount by which heat is given to each sheet of recording paper in order to ensure that toner is satisfactorily fixed to even a sheet of recording paper which is relatively large in basis weight.

Thinking about the length Tf of time it takes for the heat generated by the heater 12 to reach the inward thermistor 15 when power is supplied to the heat generating resistor on the front surface of the heater 12, the value of Th is roughly equal to the sum of the length of time it takes for the heat generated by the heat generating resistor on the front surface of the heater 12 to conduct through the surface protection layer 308 and the length of time it takes for the heat having conducted to the surface of the film 11 to reach the inward thermistor 15. Between the two lengths of time, the length of time for the heat to be made to reach the inward thermistor 15 by the rotation of the film 11 is overwhelmingly greater. Therefore, Tf is substantially affected by the recording paper conveyance speed. Therefore, when the image forming apparatus is operated at the half-speed, the value of Tf is twice the value of the Tf when the apparatus is operated at the full-speed. On the other hand, the length of time (which hereafter will be referred to Th) for the heat generated by the heater 12 to conduct to reach the thermistor 14 when power is supplied to only the heat generating resistor on the front surface of the heater 12 is roughly ½ the value of Tf when the apparatus is operated at the half-speed. Therefore, when the apparatus is operated at the half-speed, it is desired that the thermistor 14 is used.

For the reasons such as those given above, in this embodiment, the thermistor to be used for the temperature control is switched according to the recording paper conveyance speed as shown in Table 3. That is, when power is supplied to only the heat generating resistor 309, that is, the one on the front surface of the heater 12, the thermistor to be used is switched according to whether the image forming apparatus is operated at the full-speed or the half-speed.

Table 3 shows relationship between recording paper conveyance speed and which thermistor is to be used.

TABLE 3

| Feeding | Thermistor for temp control | |
|---|---|---|
| speed (m/sec) | Power supply to front resistor | Power supply to back resistor |
| 180 | Film back Thermistor | Film back Thermistor |
| 90 | Heater back Thermistor | Heater back Thermistor |

That is, in this embodiment, the image forming apparatus is switchable in recording paper conveyance speed, between the full-speed as the first conveyance speed and the half-speed, as the second conveyance speed, which is slower than the first conveyance speed. Which temperature detection element is to be used is determined according to the combination of which heat generating resistor is used and which recording medium conveyance speed is used. More specifically, in a case where power is supplied to only the heat generating resistor 309 as the first heat generating member, and the recording medium conveyance is set to the full-speed, the inward thermistor 15 is used for temperature detection. In a case where power is supplied to only the heat generating resistor 309 as the first heat generating member, and the recording medium conveyance is set to the half-speed, the thermistor 14 as the second temperature detection element is used for temperature detection. On the other hand, when power is supplied to only the heat generating resistor 305 as the second heat generating member, the thermistor 14, as the second temperature detection element, is used for temperature detection regardless of the recording paper conveyance speed. That is, it is only as the image forming apparatus is switched in recording paper conveyance speed from the first conveyance speed to the second conveyance speed, which is slower than the first one, and the power to be supplied to the first heat generating member is controlled, that the apparatus is switched in the temperature detection element from the first one to the second one. By the way, in the foregoing description of this embodiment, the image forming apparatus was operable in the full-speed or roughly half the full-speed. This apparatus is nothing but an example of image forming apparatus to which the present invention is applicable. That is, this embodiment is not intended to limit the present invention in scope in terms of recording paper conveyance speed. All that is necessary to be done when the present invention is applied to an image forming apparatus structured so that it can be varied in recording paper conveyance speed by an amount large enough to affect its fixing device in performance, is to restructure the apparatus so that it can be switched in temperature detection element to ensure that images are properly fixed.

As described above, in this embodiment, when the image forming apparatus is operated at the half-speed, the inward thermistor 15 is used to control the temperature of the film 11 to keep the temperature detected by the thermistor 14 at the target level. Thus, the phenomenon that the temperature of the film 11 fluctuates up and down does not occur. Therefore, it is possible to prevent the image forming apparatus from outputting images which suffer from such image defects as "cold-offset" or "hot offset".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-254206 filed on Dec. 25, 2015, which is hereby incorporated by reference herein in its entirety.

What is claimed is:

1. A fixing device for fixing an image on a recording material, said fixing device comprising:

a cylindrical film;

a heater contacting said film, said heater including a substrate, a first heat generating resistor provided on a first surface of said substrate, which opposes said film, and a second heat generating resistor provided on a second surface of said substrate, which is opposite from the first surface;

a temperature detecting member configured to detect a temperature of said heater on a side having the second surface; and a controller configured to control supply of electric power to said heater using one of PID control and PD control on the basis of a deviation between a target temperature and a detected temperature detected by said temperature detecting member, such that the temperature of said heater is maintained at the target temperature, wherein the image is fixed on the recording material by heat generated by said heater, wherein a proportional gain of the PID control or the PD control when said first heat generating resistor is supplied with the electric power and said second heat generating resistor is not supplied with the electric power is less than a proportional gain of the PID control or the PD control when said first heat generating resistor is not supplied with the electric power and said second heat generating resistor is supplied with the electric power, and wherein said first heat generating resistor is longer than said second heat generating resistor, as measured in a longitudinal direction of said heater.

2. The fixing apparatus according to claim 1, wherein an integration gain of the PID control or the PD control when said first heat generating resistor is supplied with the electric power and said second heat generating resistor is not supplied with the electric power is greater than an integration gain of the PID control or the PD control when said first heat generating resistor is not supplied with the electric power and said second heat generating resistor is supplied with the electric power.

3. The fixing apparatus according to claim 1, wherein a differential gain of the PID control or the PD control when said first heat generating resistor is supplied with the electric power and said second heat generating resistor is not supplied with the electric power, is less than a differential gain of the PID control or the PD control when said first heat generating resistor is not supplied with the electric power and said second heat generating resistor is supplied with the electric power.

4. The fixing apparatus according to claim 1, further comprising a roller contacting said film to constitute a nip, through which the recording material carrying the image is heated and fed.

5. The fixing apparatus according to claim 4, wherein said heater contacts an inner surface of said film to cooperate with said roller to constitute the nip between said roller and said film.

6. A fixing device for fixing an image on a recording material, said fixing device comprising:

a cylindrical film;

a heater contacting said film, said heater including a substrate, a first heat generating resistor provided on a first surface of said substrate, which opposes said film, and a second heat generating resistor provided on a second surface of said substrate, which is opposite from the first surface;

a temperature detecting member configured to detect a temperature of said heater on a side having the second surface; and a controller configured to control supply of electric power to said heater using one of PID control and PD control on the basis of a deviation between a target temperature and a detected temperature detected by said temperature detecting member, such that the temperature of said heater is maintained at the target temperature, wherein the image is fixed on the recording material by heat generated by said heater, wherein a control parameter of the PID control or the PD control when said first heat generating resistor is supplied with the electric power and said second heat generating resistor is not supplied with the electric power is different than a control parameter of the PID control or the PD control when said first heat generating resistor is not supplied with the electric power and said second heat generating resistor is supplied with the electric power, and wherein said first heat generating resistor is longer than said second heat generating resistor, as measured in a longitudinal direction of said heater.

* * * * *